US011125177B2

(12) United States Patent
Lee et al.

(10) Patent No.: US 11,125,177 B2
(45) Date of Patent: Sep. 21, 2021

(54) SYSTEM FOR CONTROLLING AIR-FUEL RATIO FOR FLEX FUEL VEHICLE USING OXYGEN STORAGE AMOUNT OF CATALYST AND METHOD THEREOF

(71) Applicants: HYUNDAI MOTOR COMPANY, Seoul (KR); KIA MOTORS CORPORATION, Seoul (KR)

(72) Inventors: Dong-Hoon Lee, Gunpo-si (KR); Pyung-Hyun Han, Seoul (KR); Ki-Joon Lee, Incheon (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/869,055

(22) Filed: May 7, 2020

(65) Prior Publication Data

US 2021/0207549 A1 Jul. 8, 2021

(30) Foreign Application Priority Data

Jan. 6, 2020 (KR) ..... 10-2020-0001446

(51) Int. Cl.
*F02D 41/14* (2006.01)
*F02D 41/02* (2006.01)
*F02D 41/00* (2006.01)

(52) U.S. Cl.
CPC ..... *F02D 41/1454* (2013.01); *F02D 41/0052* (2013.01); *F02D 41/0295* (2013.01); *F02D 41/1441* (2013.01)

(58) Field of Classification Search
CPC ..... F02D 41/1454; F02D 41/1441; F02D 41/0052; F02D 41/0295
See application file for complete search history.

(56) References Cited

U.S. PATENT DOCUMENTS 5,661,972 A * 9/1997 Katoh ..... F02D 41/1441 60/276
2006/0005533 A1* 1/2006 Takubo ..... F02D 41/1488 60/285
2008/0295488 A1* 12/2008 Takubo ..... F02D 41/0295 60/276
2010/0218485 A1* 9/2010 Fujiwara ..... F02D 41/027 60/276
2011/0314795 A1* 12/2011 Tani ..... F01N 11/00 60/276
2017/0002760 A1* 1/2017 Hayashita ..... F02D 41/065
2017/0218868 A1* 8/2017 Okazaki ..... F02D 41/2454

FOREIGN PATENT DOCUMENTS

KR 10-0444445 B1 8/2004

* cited by examiner

*Primary Examiner* — Joseph J Dallo

(57) ABSTRACT

A method for controlling an air-fuel ratio based on an oxygen storage amount of a catalyst may include: performing, by a controller, a catalyst oxygen storage amount (OSA) feedback control for a rich control of the air-fuel ratio so that the oxygen storage amount of the catalyst is within a threshold value; and performing, by the controller, a target voltage feedback control for a lean or rich control of the air-fuel ratio so that an output voltage value of an oxygen sensor provided in the rear of the catalyst satisfies a target voltage value.

9 Claims, 7 Drawing Sheets

SYSTEM FOR CONTROLLING AIR-FUEL RATIO FOR FLEX FUEL VEHICLE USING OXYGEN STORAGE AMOUNT OF CATALYST AND METHOD THEREOF

CROSS-REFERENCE TO RELATED APPLICATION

This application claims priority to and the benefit of Korean Patent Application No. 10-2020-0001446, filed on Jan. 6, 2020, the entire contents of which are incorporated herein by reference.

FIELD

The present disclosure relates to a system and a method for controlling an air-fuel ratio of a vehicle to improve a purification effect of a catalyst.

BACKGROUND

The statements in this section merely provide background information related to the present disclosure and may not constitute prior art.

In order to satisfy exhaust gas regulations being continuously strengthened, technologies related to exhaust gas reduction have been actively developed. In relation to this, in order to reduce an exhaust gas before post-processing, devices, such as an exhaust gas recirculation (EGR) system and a continuously variable valve duration (CVVD) system capable of continuously changing the opening and closing timings of cylinder valves (e.g., intake and exhaust valves), have been developed. Further, in relation to exhaust gas purification technology using a catalyst, efforts to reduce a noble metal put into the catalyst have continuously been made while improving the purification capability of the catalyst.

Meanwhile, for maximum utilization of the purification capability of the catalyst in order to suppress the cost increase of the catalyst caused by the increase of the noble metal, researches for a method for accurately predicting and controlling the state of the catalyst have been actively made. In particular, in the case of a three-way catalyst (TWC) device mounted on a gasoline engine, it is known that the TWC device has the characteristic of effectively purifying CO/HC/NOx that are three primary exhaust gas components included in the exhaust gas on a theoretical air-fuel ratio condition. Meanwhile, in the case of the three-way catalyst, as the traveling distance becomes increased, the catalyst becomes deteriorated to reduce the oxygen storage capacity (OSC). Due to this, in order to control the three-way catalyst in an optimum state, it is required to perform a proper air-fuel ratio control based on the oxygen storage amount of the catalyst.

As a method for controlling an air-fuel ratio for controlling a three-way catalyst in an optimum state, a method for controlling an air-fuel ratio so that a voltage of an oxygen sensor in the rear of a catalyst follows a specific target value (target voltage feedback control or trim control) may be considered.

However, we have discovered that, as illustrated in FIG. 4, in the case of a binary oxygen sensor used in the rear of the catalyst, the hysteresis response characteristic exists, and thus it is not possible to promptly control the exhaust gas air-fuel ratio only through the target voltage feedback control, and on a dynamic driving condition, there is a limit in effectively removing pollution of the exhaust gas. Further, due to the oxygen storage characteristic of the three-way catalyst, the lean detection of the oxygen sensor in the rear of the catalyst is delayed until the catalyst is completely oxidized, and in this case, NOx exhaust gas included in the exhaust gas is discharged in the air as it is without being purified.

In consideration of this point, as another method for controlling an air-fuel ratio for controlling the three-way catalyst, a method for calculating the current oxygen storage amount of the catalyst and controlling the air-fuel ratio so that the calculated oxygen storage amount satisfies a specific range (catalyst oxygen storage amount (OSA) feedback control) may be considered.

However, we have found that in the case of the catalyst oxygen storage amount feedback control as described above, if an error occurs in a model for calculating the oxygen storage amount of the catalyst in accordance with the detection accuracy of the catalyst oxygen sensor and an air amount measurement accuracy, the discharge amount of the unpurified exhaust gas is unavoidably increased.

SUMMARY

The present disclosure provides a method and a system for controlling an air-fuel ratio, which can maintain an optimum purification efficiency of a catalyst promptly and stably.

Other objects and advantages of the present disclosure can be understood by the following description, and become apparent with reference to the forms of the present disclosure. Also, it is obvious to those skilled in the art to which the present disclosure pertains that the objects and advantages of the present disclosure can be realized by the means as claimed and combinations thereof.

In one form of the present disclosure, a method for controlling an air-fuel ratio based on an oxygen storage amount of a catalyst includes: performing, by a controller, a catalyst oxygen storage amount (OSA) feedback control for a rich control of the air-fuel ratio so that the oxygen storage amount of the catalyst is within a specific threshold value; and performing, by the controller, a target voltage feedback control for a lean or rich control of the air-fuel ratio so that an output voltage value of a rear oxygen sensor arranged in the rear of the catalyst satisfies a target voltage value.

According to the present disclosure, if it is necessary to promptly purify an exhaust gas generated in a dynamic driving region, the catalyst is promptly reduced through an air-fuel ratio feedback control based on the oxygen storage amount, whereas in a region in which the characteristic of a binary oxygen sensor in the rear of the catalyst can be well utilized, the purification efficiency of the catalyst can be optimized more promptly and stably through performing of an air-fuel ratio feedback control based on an output voltage value of the binary oxygen sensor.

In one form, the catalyst oxygen storage amount (OSA) feedback control includes: calculating the oxygen storage amount (OSA) of the catalyst based on an air-fuel ratio measured by a front oxygen sensor arranged in front of the catalyst and a flow rate of an exhaust gas; comparing the calculated oxygen storage amount (OSA) with the threshold value; and when the calculated oxygen storage amount exceeds the threshold value, performing the rich control of the air-fuel ratio so that the oxygen storage amount (OSA) becomes equal to or less than the threshold.

In another form, the target voltage feedback control includes: calculating the target voltage value based on a current driving condition of a vehicle and a theoretical air-fuel ratio; comparing the output voltage value of the rear oxygen sensor with the calculated target voltage value; when the output voltage value of the rear oxygen sensor is greater than the target voltage value, performing the lean control of the air-fuel ratio so that the output voltage value follows the target voltage value; and when the output voltage value of the rear oxygen sensor is less than the target voltage value, performing the rich control of the air-fuel ratio so that the output voltage value follows the target voltage value.

In some forms of the present disclosure, the method further includes: when the calculated oxygen storage amount is equal to or less than the threshold value, performing the target voltage feedback control. In another form, performing the target voltage feedback control includes: calculating the target voltage value based on a current driving condition of a vehicle and a theoretical air-fuel ratio; comparing the output voltage value of the rear oxygen sensor with the calculated target voltage value; when the output voltage value of the rear oxygen sensor is greater than the target voltage value, performing the lean control of the air-fuel ratio so that the output voltage value follows the target voltage value; and when the output voltage value of the rear oxygen sensor is less than the target voltage value, performing the rich control of the air-fuel ratio so that the output voltage value follows the target voltage value.

In some forms of the present disclosure, the method further includes: interrupting the feedback control and monitoring the oxygen storage amount being calculated in real time if the calculated oxygen storage amount (OSA) is equal to or smaller than the threshold value; and interrupting the target voltage feedback control and resuming the feedback control if the oxygen storage amount (OSA) being calculated in real time exceeds the threshold value.

In some forms of the present disclosure, the method further includes: performing the lean control or the rich control of the air-fuel ratio so that the air-fuel ratio measured by the front oxygen sensor in front of the catalyst follows a theoretical air-fuel ratio.

In some forms of the present disclosure, calculating the oxygen storage amount (OSA) of the catalyst includes: calculating an oxygen mass flow rate flowing into the catalyst from the air-fuel ratio measured by the front oxygen sensor in front of the catalyst and a flow rate of an exhaust gas; and calculating an oxygen storage capacity (OSC) of the catalyst by integrating the oxygen mass flow rate.

The method further includes: determining, by the controller, whether a condition to perform the catalyst oxygen storage amount (OSA) feedback control is satisfied; and performing, by the controller, the catalyst oxygen storage amount (OSA) feedback control when the condition is satisfied.

The method further includes: determining, by the controller, whether a condition to perform the target voltage feedback control is satisfied; and performing, by the controller, the target voltage feedback control when the condition is satisfied.

In another form of the present disclosure, a system for controlling an air-fuel ratio based on an oxygen storage amount of a catalyst includes: an engine that is a power source; the catalyst installed on an exhaust line of the engine and configured to purify an exhaust gas being discharged from the engine; first and second oxygen sensors respectively installed on an upstream and a downstream of the catalyst on the exhaust line; and a controller configured to perform a catalyst oxygen storage amount feedback control and a target voltage feedback control so as to control the air-fuel ratio. In particular, the catalyst oxygen storage amount (OSA) feedback control is configured to perform a rich control of the air-fuel ratio so that the oxygen storage amount of the catalyst is within a threshold value, and a target voltage feedback control is configured to perform a lean or rich control of the air-fuel ratio so that an output voltage value of the second oxygen sensor provided in the rear of the catalyst satisfies a target voltage value.

In one form, when the oxygen storage amount of the catalyst exceeds the threshold value controller is configured to perform the catalyst oxygen storage amount feedback control. In another form, when the oxygen storage amount of the catalyst is equal to or less than the threshold value, the controller is configured to perform the target voltage feedback control.

According to the exemplary forms of the present disclosure, it is possible to maintain the purification efficiency of the catalyst in the optimum state promptly and stably by configuring the target voltage value of the oxygen sensor in the rear of the catalyst and controlling the air-fuel ratio so that the voltage value of the oxygen sensor follows the target voltage value and simultaneously by configuring the threshold value of the oxygen storage amount of the catalyst and controlling the oxygen storage amount in the catalyst within the given threshold value.

According to the forms of the present disclosure, the exhaust gas regulations being continuously strengthened can be satisfied. Further, it is possible to reduce the manufacturing cost through reduction of the cost of the catalyst by suppressing the overuse of expensive materials when developing the catalyst in order to fully satisfy the exhaust gas regulations.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 6:
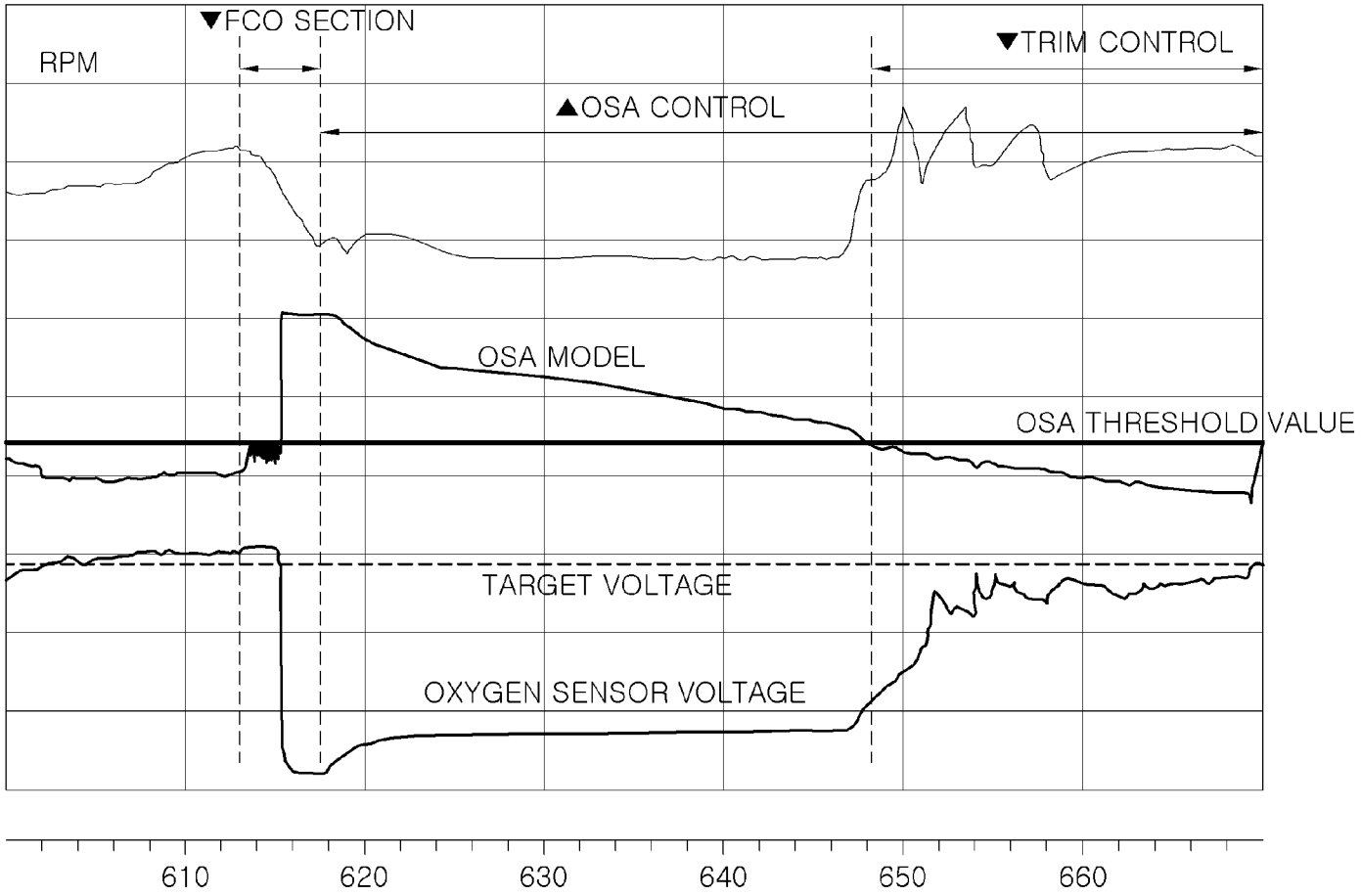
Figure 7:
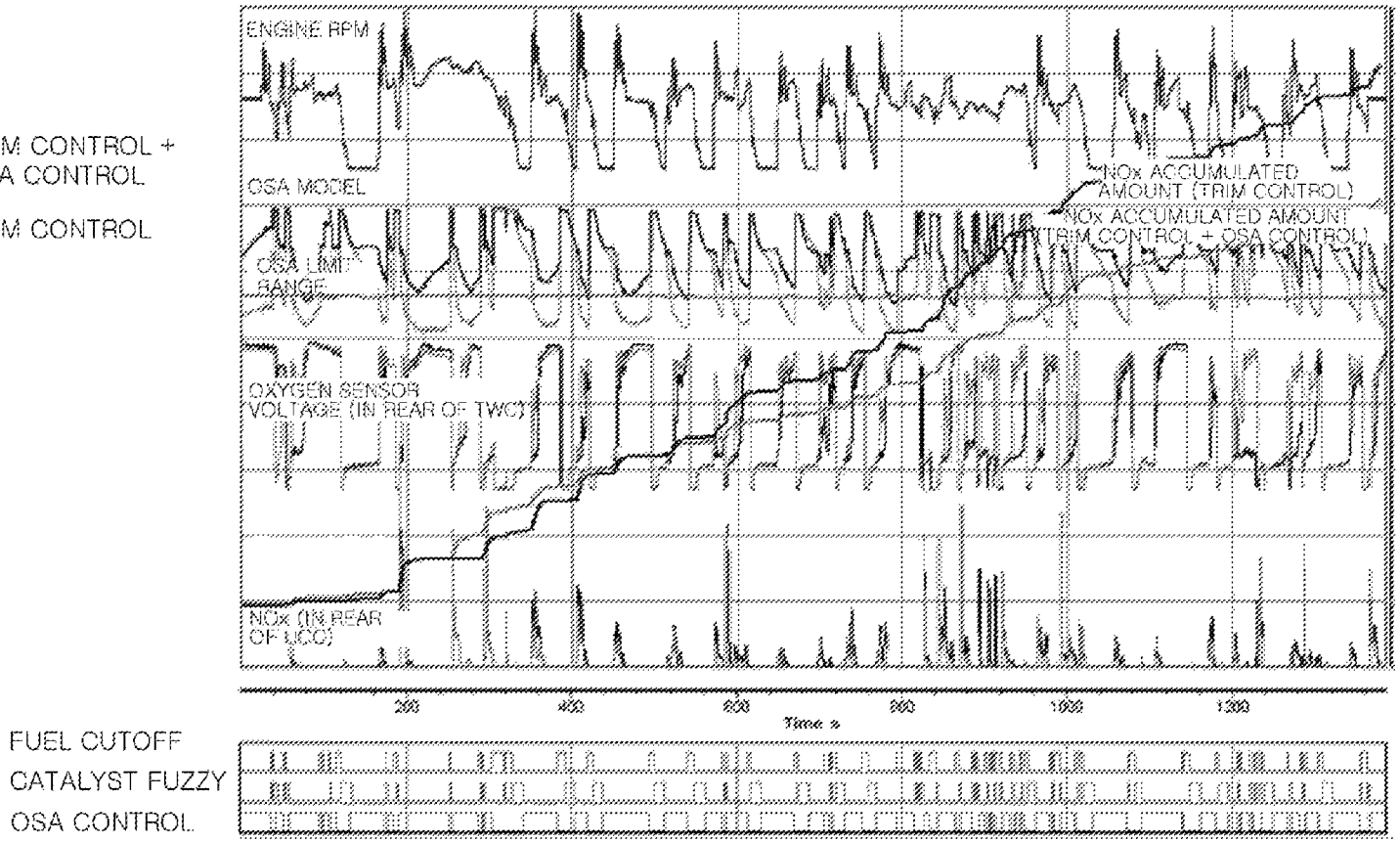

FIG. 6 is a diagram illustrating changes of an oxygen sensor voltage and an oxygen storage amount (OSA) in the case of performing a control method according to one form of the present disclosure during an actual vehicle driving; and FIG. 7 is a graph illustrating exhaust gas purification effects in the case of performing only a trim control (target voltage feedback control) and in the case of performing a control according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, exemplary forms of the present disclosure will be described in detail with reference to the accompanying exemplary drawings.

Figure 1:
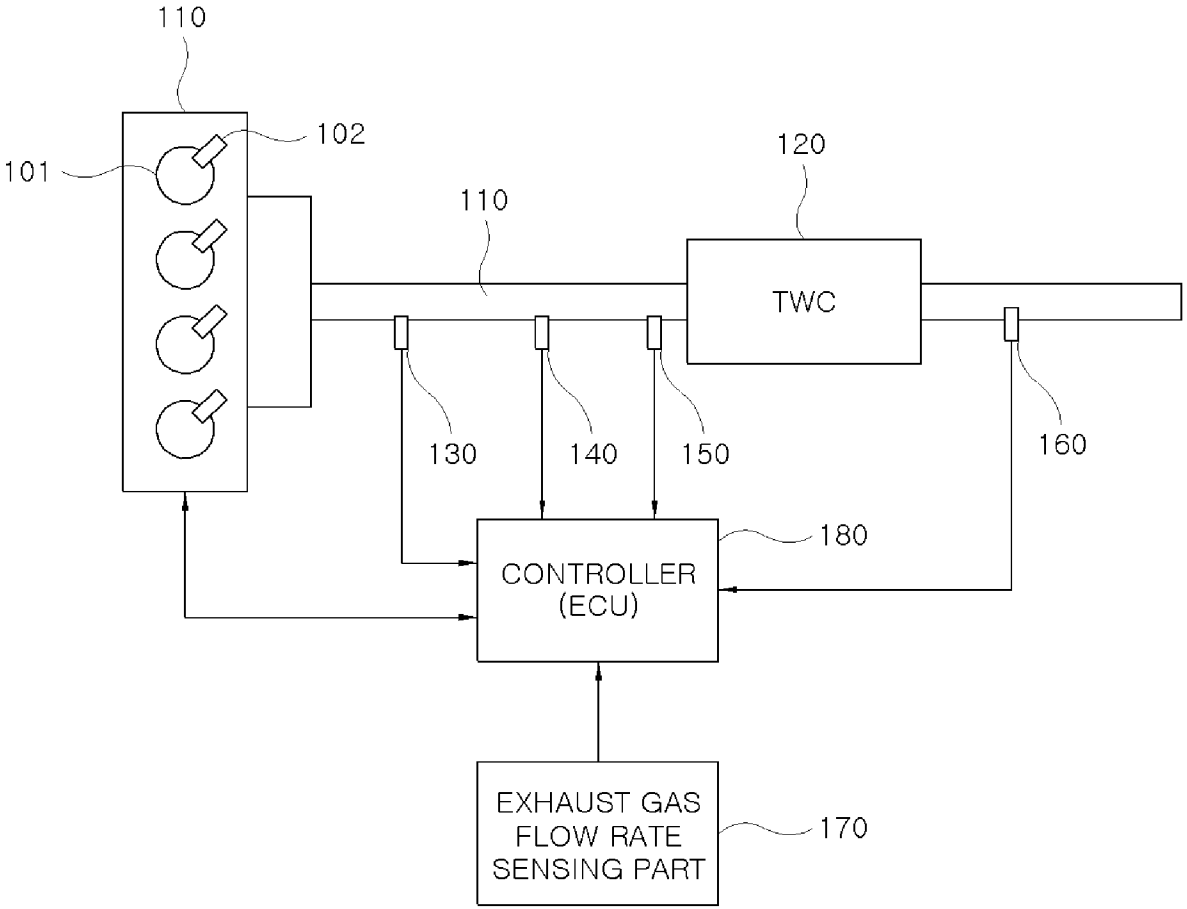
FIG. 1 is a diagram schematically illustrating the structure of a system for controlling an air-fuel ratio according to one form of the present disclosure.

FIG. 1 is a diagram schematically illustrating the structure of a system for controlling an air-fuel ratio in one form of the present disclosure.

With reference to FIG. 1, a system for controlling an air-fuel ratio includes: an engine 100, a combustion chamber 101, an injector 102, an exhaust line 110, a three-way catalyst 120, a linear oxygen sensor 130 in front of the catalyst, an exhaust gas temperature sensor 140, an exhaust gas pressure sensor 150, a binary oxygen sensor 160 in the rear of the catalyst, an exhaust gas flow rate sensing part 170, and a controller 180.

In the engine 100 as exemplified in FIG. 1, a fresh air being supplied from an intake system of a vehicle is supplied to the combustion chamber 101 in a cylinder through an intake valve (not illustrated). Further, a fuel being pressingly transferred from a fuel tank is supplied to the combustion chamber 101 in the cylinder through the injector 102. In the engine 100 as exemplified in FIG. 1, the injector 102 directly injects the fuel into the combustion chamber, but the method according to one form of the present disclosure can be applied even to an engine in which a mixture of the fuel and the air is supplied into the combustion chamber through the intake valve in addition to the above-described type of engine. The injector 102 adjusts a fuel amount being injected into the combustion chamber 101 through adjustment of an injector closing time under the control of the controller 180 to be described later. Through this, the air-fuel ratio is controlled.

The fuel injected into the combustion chamber 101 is ignited in the combustion chamber 101 to achieve the combustion. An exhaust gas created after the combustion is discharged to the exhaust line 110 of an exhaust system through the exhaust valve.

The exhaust gas being discharged to the exhaust line 110 is discharged out of the vehicle after harmful components are removed by the catalyst 120 in a catalyst converter. In one form, the catalyst 120 is a three-way catalyst (TWC) that not only oxidizes CO or HC, but also separates oxygen from nitrogen oxides and performs reduction to change to harmless nitrogen or oxygen. The three-way catalyst 120 changes harmful materials including carbon monoxide, hydrocarbon, and nitrogen oxides included in the exhaust gas to harmless components by oxidation-reduction reactions.

On the other hand, on upstream and downstream sides of the three-way catalyst 120 on the exhaust line 110, oxygen sensors 130 and 160 for detecting the concentration of oxygen in the exhaust gas are respectively installed.

In another form, the oxygen sensor 130 installed on the upstream side of the three-way catalyst 120 is a linear oxygen sensor, and is configured to detect an air-fuel ratio (lambda value) of the exhaust gas passing through the exhaust line 110 and to transmit the detected signal to the controller 180.

In other form, the oxygen sensor 160 installed on the downstream side of the three-way catalyst 120 is a binary oxygen sensor, and is configured to measure the oxygen concentration of the exhaust gas passing through the three-way catalyst 120 and to transmit the measured signal to the controller 180.

The exhaust gas temperature sensor 140 is installed on the upstream or the downstream of the three-way catalyst 120, and is configured to measure the temperature of the exhaust gas and the temperature of the three-way catalyst and to transmit the measured signal to the controller 180.

The exhaust gas pressure sensor 150 is installed on the upstream or the downstream of the three-way catalyst 120, and is configured to measure the pressure of the exhaust gas and to transmit the measured signal to the controller 180.

The exhaust gas flow rate sensing part 170 senses the flow rate of the exhaust gas and transmits the signal to the controller 180 by calculating the flow rate of the exhaust gas through an intake flow rate, a fuel injection amount, and an exhaust gas temperature, directly measuring the exhaust gas flow rate using the exhaust gas flow rate sensor, or selecting the flow rate value from map data configured in accordance with the driving condition.

The controller (electronic control unit (ECU)) 180 calculates a mass flow rate mot of oxygen flowing into the three-way catalyst 120 from flow rate information of the exhaust gas transferred from the exhaust gas flow rate sensing part 170, temperature and pressure information of the exhaust gas transferred from the exhaust gas pressure sensor 150 and the exhaust gas temperature sensor 140, and the air-fuel ratio information transferred from the linear oxygen sensor 130 in front of the catalyst, and the controller 180 calculates an oxygen storage amount (OSA) of the three-way catalyst 120 from the calculated mass flow rate $m_{O2}$ of the oxygen.

Further, the controller 180 controls the air-fuel ratio by simultaneously performing a catalyst oxygen storage amount feedback control for performing a rich control of the air-fuel ratio so that the calculated oxygen storage amount (OSA) of the three-way catalyst 120 is within a specific predetermined threshold value and a target voltage feedback control for performing a lean or rich control of the air-fuel ratio so that an output voltage value of the binary oxygen sensor 160 in the rear of the catalyst satisfies a target voltage value.

Further, the controller 180 may perform a feedback control so that the measured air-fuel rate follows a target air-fuel ratio based on the air-fuel ratio measurement result received from the linear oxygen sensor 130 in front of the catalyst.

Here, the air-fuel ratio may be achieved by controlling the fuel amount being injected from the injector 102 through the control of the closing time of the injector 102. Further, the air-fuel ratio may be controlled by controlling the fresh air amount flowing into the combustion chamber through controlling of a throttle valve (not illustrated) instead of controlling the injector 102. A detailed control method performed by the controller 180 will now be described in detail.

Figure 2:
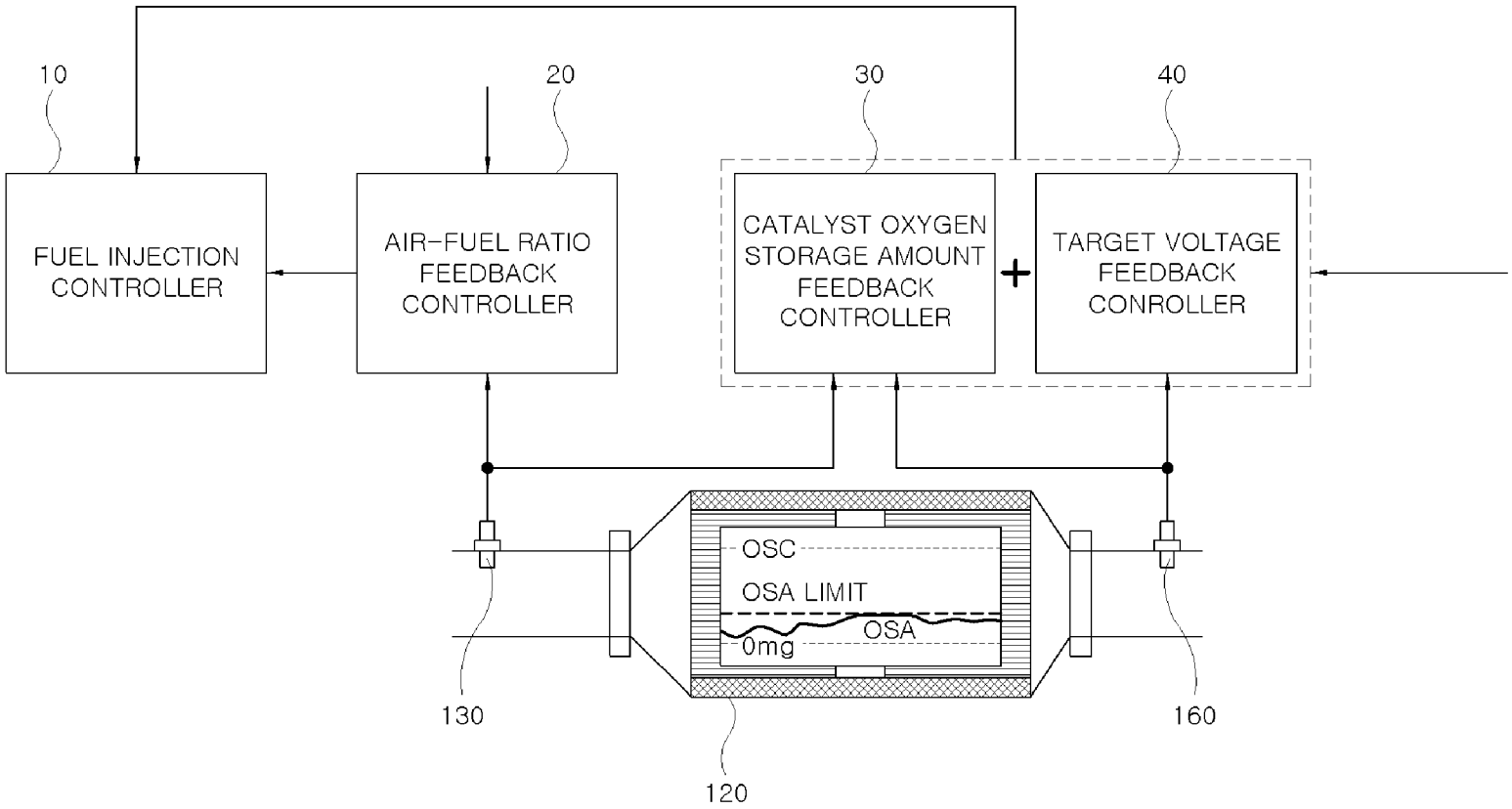
FIG. 2 is a schematic diagram illustrating a signal process related to a control method according to one form of the present disclosure.

FIG. 2 is a schematic diagram illustrating a signal process related to a control method that is performed by the controller 180 of FIG. 1 according to another form of the present disclosure.

In one form, the controller 180 is composed of a fuel injection controller 10, an air-fuel ratio feedback controller 20, a catalyst oxygen storage amount feedback controller 30, and a target voltage feedback controller 40.

The fuel injection controller 10 controls the injector 102 so that a specific air-fuel ratio can be achieved in accordance with the air-fuel feedback control that is performed by the air-fuel ratio feedback controller 20, the catalyst oxygen storage amount feedback controller 30, and the target voltage feedback controller 40. In one form, the fuel injection controller 10 controls the injector to inject the fuel of a specific flow rate by controlling the closing time of the injector 102 as long as the time corresponding to the injection flow rate capable of achieving the target air-fuel ratio based on a map related to the relationship between the closing time of the injector 102 and the injection flow rate. However, in the present disclosure, the method for controlling the air-fuel ratio is not limited to the control of the fuel amount, but it may control the air-fuel ratio by controlling the fresh air amount flowing into the combustion chamber 101. In this case, the fuel injection controller 10 may make the fresh air flow as high as the flow rate satisfying the target air-fuel ratio by adjusting the opening degree of the throttle valve (not illustrated) provided in the intake system instead of the injector 102.

The air-fuel ratio feedback controller 20 determines the target air-fuel ratio, receives the measured air-fuel ratio measured by the linear oxygen sensor 130 in front of the catalyst, and controls the fuel injection controller 10 so that the measured air-fuel ratio follows the target air-fuel ratio. In the case of the ordinary three-way catalyst 120, as the air-fuel ratio measured by the linear oxygen sensor 130 becomes closer to the theoretical air-fuel ratio, the oxidation and reduction reactions are balanced to show the optimum purification efficiency. In one form, the target air-fuel ratio may be set to the theoretical air-fuel ratio.

The catalyst oxygen storage amount feedback controller 30 performs the catalyst oxygen storage amount feedback control to perform rich control of the air-fuel ratio by controlling the fuel injection controller 10 so that the three-way catalyst 120 calculates the oxygen storage amount (OSA) and the calculated oxygen storage amount (OSA) is within the specific predetermined threshold value. Ordinarily, if the catalyst oxygen storage amount (OSA) exceeds the constant threshold value, the calculation accuracy of a catalyst oxygen storage amount (OSA) calculation model sensitively acts on the purification efficiency of the catalyst. Further, in the corresponding region, the level of the catalyst oxygen storage amount (OSA) is high, and thus it is not easy to promptly purify the exhaust gas generating in a dynamic driving region. Accordingly, if the oxygen storage amount calculated by the oxygen storage amount (OSA) calculation model provided in the catalyst oxygen storage amount feedback controller 30 exceeds the specific threshold value, and in particular, if the oxygen in the catalyst is in a saturated state through long-term driving in a fuel-cutoff (FCO) state, the rich feedback control of the air-fuel ratio is performed to promptly reduce the three-way catalyst 120 until the calculated oxygen storage amount (OSA) becomes equal to or smaller than the threshold value.

The catalyst oxygen storage amount feedback controller 30 performs the rich control of the air-fuel ratio, and if the oxygen storage amount (OSA) stored in the three-way catalyst 120 becomes smaller than the threshold value, the catalyst oxygen storage amount feedback controller 30 temporarily stops the rich feedback control of the air-fuel ratio using the oxygen storage amount (OSA). Further, the catalyst oxygen storage amount feedback controller 30 monitors whether the oxygen storage amount (OSA) is continuously maintained to be equal to or smaller than the threshold value by monitoring in real time the oxygen storage amount (OSA) being calculated in real time. If the oxygen storage amount (OSA) exceeds the threshold value again in accordance with the temporary lean combustion on a driving condition on which the load is large as in the dynamic driving mode and the variation width of the air-fuel ratio is large, the air-fuel ratio rich feedback control is performed again to control the fuel injection controller 10 so that the oxygen amount stored in the three-way catalyst 120 is always maintained to be equal to or smaller than the threshold value.

Meanwhile, the oxygen storage amount (OSA) calculation model provided in the catalyst oxygen storage amount feedback controller 30 calculates the oxygen storage amount in the following method.

First, the oxygen storage amount (OSA) calculation model calculates the mass flow rate $m_{02}$ of oxygen in the exhaust gas flowing into the three-way catalyst 120 from the air-fuel ratio $\lambda_{linear}$ being transferred from the linear oxygen sensor 130 in front of the three-way catalyst 120, the exhaust gas flow rate $m_{exh}$ being transferred from the exhaust gas flow rate sensing part 170, the exhaust gas temperature $T_{exh}$ and the exhaust gas pressure $P_{exh}$ being respectively transferred from the exhaust gas temperature sensor 140 and the exhaust gas pressure sensor 150.

In one form, the mass flow rate $m_{02}$ of oxygen in the exhaust gas is calculated by the following equation 1.

$$m_{02} = 0.23 \times \left(1 - \frac{1}{\lambda_{linear}}\right) \times m_{exh}(P_{exh}, T_{exh}) \quad \text{(Equation 1)}$$

In accordance with the exhaust gas temperature $T_{exh}$ and the exhaust gas pressure $P_{exh}$, the gas characteristics differ in the same exhaust gas flow rate $m_{exh}$. As disclosed in Equation 1, in the case of calculating the mass flow rate $m_{02}$ of oxygen in the exhaust gas, it is desired to substitute a corrected value $m_{exh}$ ($P_{exh}$, $T_{exh}$) of the exhaust gas flow rate $m_{exh}$ using values of the exhaust gas temperature $T_{exh}$ and the exhaust gas pressure $P_{exh}$ so Pas to calculate the accurate mass flow rate of oxygen.

Further, the oxygen storage amount (OSA) calculation model calculates the oxygen storage amount of the three-way catalyst 120 by integrating the calculated mass flow rate $m_{02}$ of oxygen. Here, in one form, the oxygen storage amount (OSA) is calculated by integrating the mass flow rate ($m_{02}$) of oxygen from the fuel-cutoff time to the time when the voltage of the binary oxygen sensor 160 in the rear of the three-way catalyst 120 indicates the lean state of the air-fuel ratio.

The target voltage feedback controller 40 controls the fuel injection controller 10 to perform the target voltage feedback control that is the lean or rich control of the air-fuel ratio so that the output voltage value of the binary oxygen sensor 160 in the rear of the catalyst satisfies the target voltage value.

The target voltage feedback controller 40 configures the target voltage value, and monitors the output voltage value of the binary oxygen sensor 160 in the rear of the catalyst. If the output voltage value is smaller than the target voltage value, it performs the rich control of the air-fuel ratio, whereas if the output voltage value is larger than the target voltage value, it performs the lean control of the air-fuel ratio. As described above, the purification efficiency of the catalyst 120 becomes optimum in the neighborhood of the theoretical air-fuel ratio. Accordingly, the target voltage value is configured as the output voltage value of the binary oxygen sensor 160 in a state where the air-fuel ratio satisfies the theoretical air-fuel ratio based on the load and the engine RPM in a driving region that satisfies the condition of the steady state. Through this, the catalyst 120 may show the optimum purification efficiency. In this case, during the target voltage feedback control, the integration control part serves to correct the oxygen characteristics in front of the catalyst.

The controller 180 may be realized in the form of a computer provided in the vehicle. In this case, a program for realizing the control function may be recorded in a computer readable recording medium, and the program recorded in the recording medium may be read by the computer system. Further, the term "computer system" as mentioned herein may be a computer system built in the vehicle, and it may include hardware, such as the OS or peripheral devices. Further, the term "computer readable recording medium" means a storage device, such as a flexible disc, an optical magnetic disc, a portable medium, such as ROM or CD-ROM, and a hard disk built in the computer system. Further, the term "computer readable recording medium" may include a short-term dynamic program maintaining, such as communication lines in the case of transmitting the program through a network, such as Internet, or communication lines, such as telephone lines, and it may include a constant-term program maintaining, such as a volatile memory inside the computer system that becomes a server or a client in that case. Further, the program may be to realize a part of the above-described function, or it may be realized as a combination with a program prerecorded in the computer system having the above-described function.

Further, in the above-described form, some or all models of the controller 180 may be realized as an integrated circuit, such as large scale integration (LSI). Each model of the controller 180 may be an individual processor, or some or all models may be integrated into a processor. Further, the technique of the integrated circuit is not limited to the LSI, but may be realized as a dedicated circuit or a general-purpose processor. Further, if the integrated circuit technology that substitutes for the LSI appears with the progress of semiconductor technology, the integrated circuit by the corresponding technology may be used.

As described above, the system for controlling the air-fuel ratio according to the present disclosure simultaneously performs the catalyst oxygen storage amount (OSA) feedback control for performing the rich control of the air-fuel ratio so that the oxygen storage amount of the catalyst is within the specific threshold value and the target voltage feedback control for performing the lean or rich control of the air-fuel ratio so that the output voltage value of the oxygen sensor in the rear of the catalyst satisfies the target voltage value.

Figure 5:
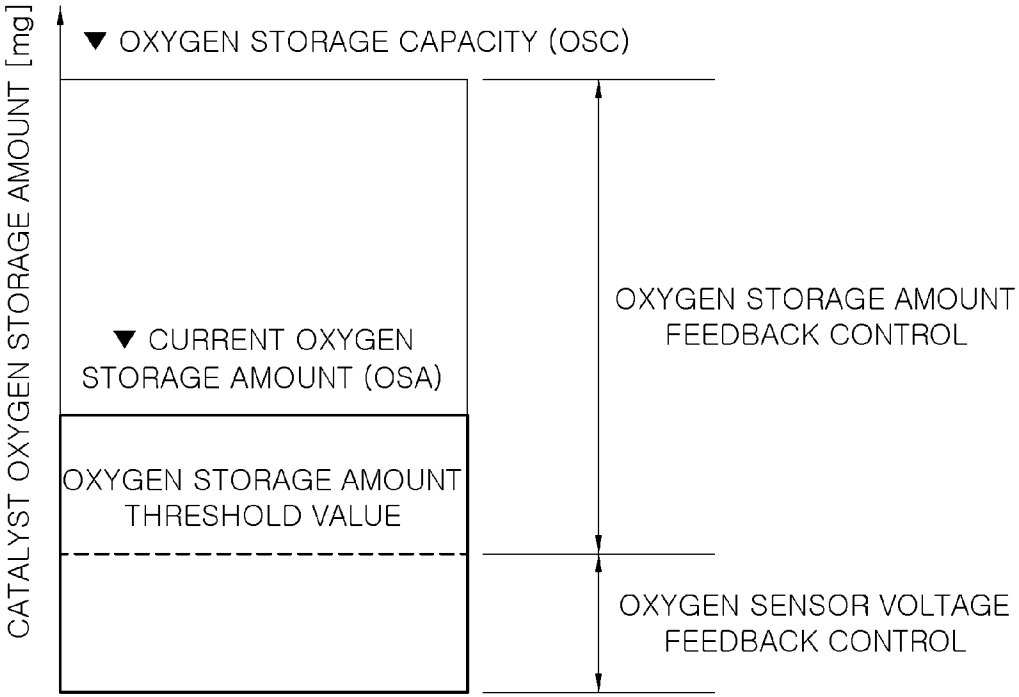
FIG. 5 is a diagram explaining the relationship between a threshold value of an oxygen storage amount of a catalyst and a feedback control method.

Further, as illustrated in FIG. 5, if the oxygen storage amount (OSA) exceeds the threshold value, the air-fuel ratio feedback control based on the oxygen storage amount (OSA) is performed so as to promptly store the exhaust gas in the dynamic driving mode. Further, if the oxygen storage amount (OSA) is equal to or smaller than the threshold value, it corresponds to a section where the characteristics of the binary oxygen sensor 160 can be well utilized for the air-duel ratio control, and thus the air-fuel ratio feedback control (trim control) is performed based on the output voltage value of the binary oxygen sensor 160 in the rear of the catalyst. Accordingly, the problem occurring in the case of the air-fuel ratio control based on the oxygen storage amount (OSA) model and the problem occurring in the case of the air-fuel ratio control based on the output voltage value of the oxygen sensor in the rear of the catalyst can be solved at a stroke to achieve the optimum purification efficiency of the catalyst.

Figure 3:
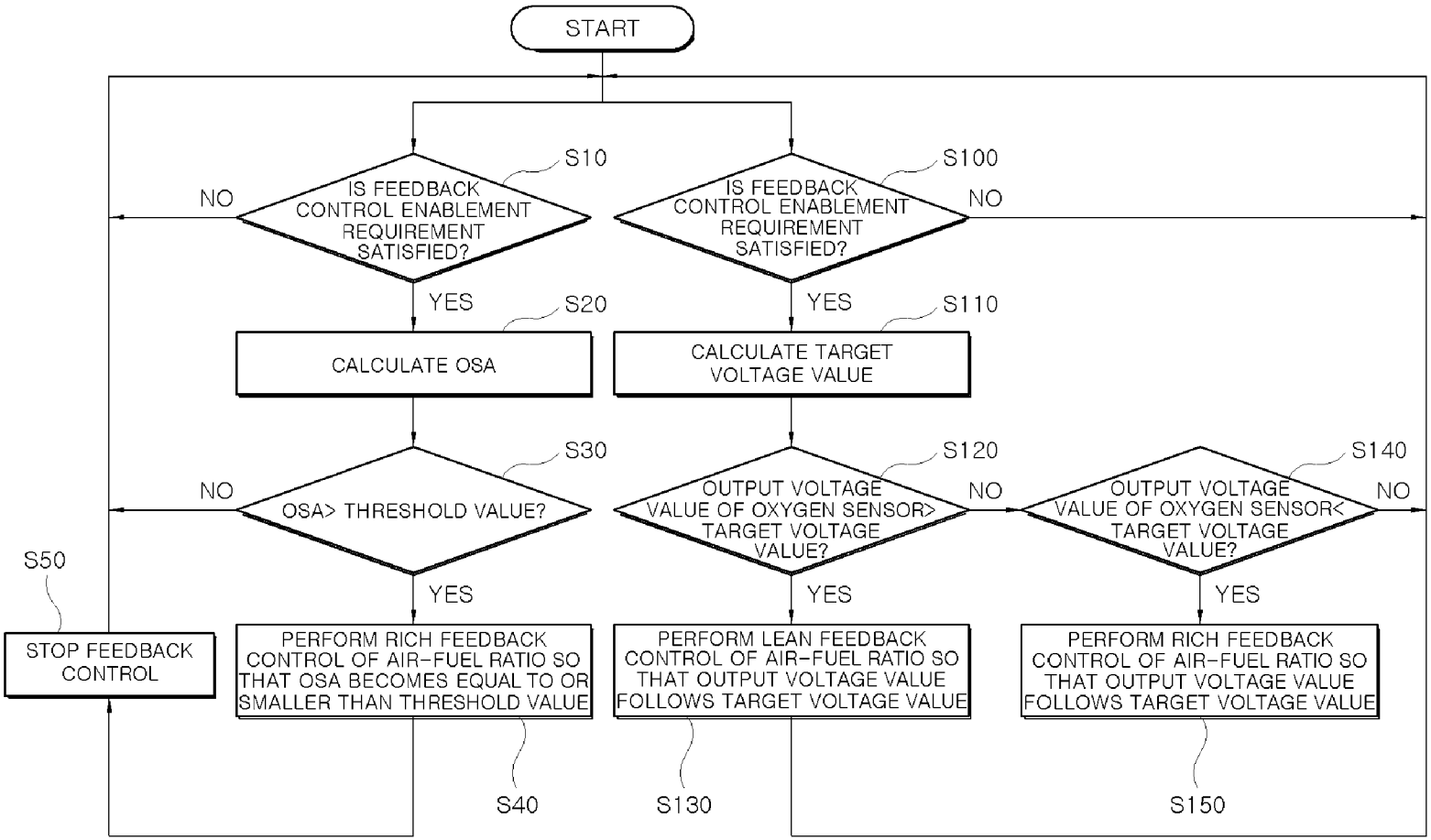
FIG. 3 is a flowchart illustrating a method for controlling an air-fuel ratio according to another form of the present disclosure.
Figure 4:
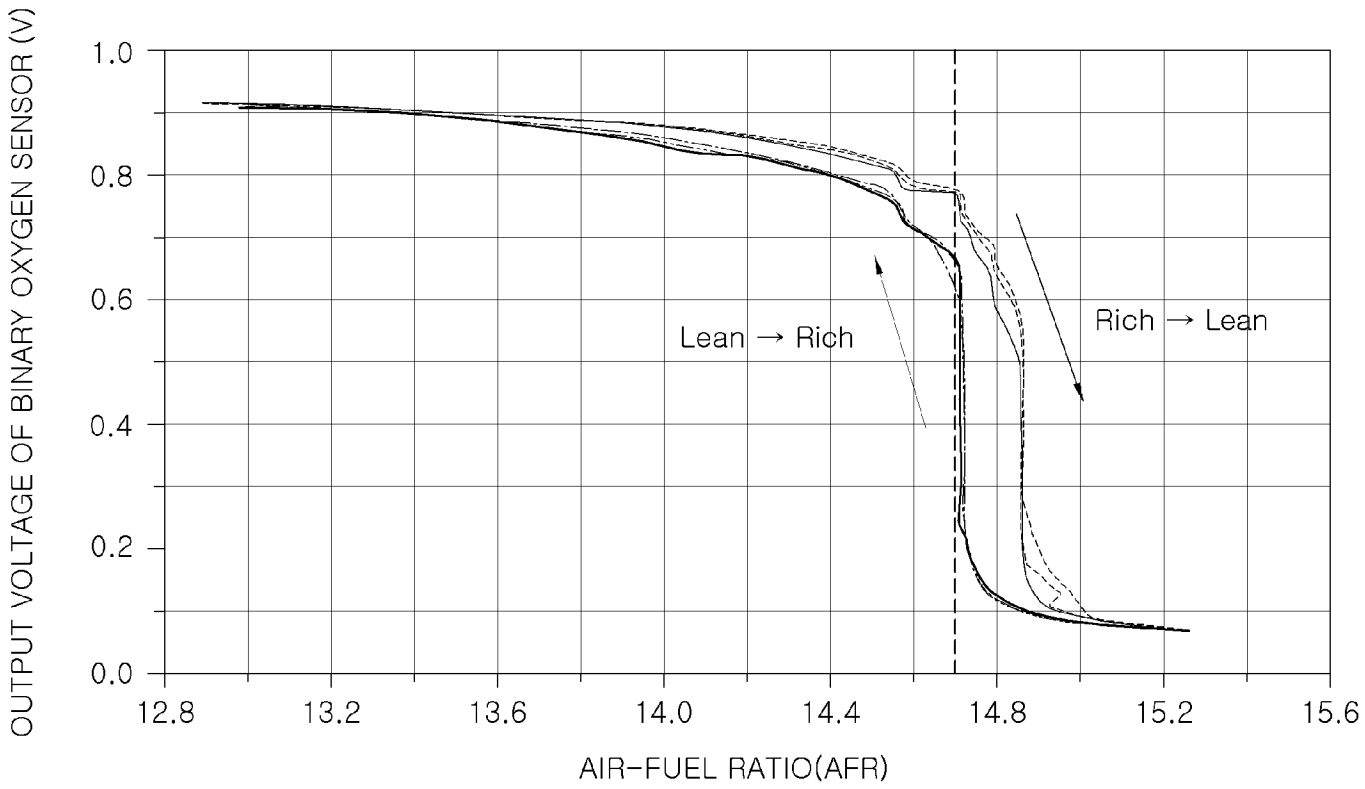
FIG. 4 is a graph illustrating the relationship between an air-fuel ratio and an output voltage value of an oxygen sensor in the rear of a catalyst.

FIG. 3 is a flowchart illustrating a method for controlling an air-fuel ratio using the system for controlling the air-fuel ratio disclosed in FIG. 2 according to one form of the present disclosure.

As illustrated in FIG. 3, according to the method for controlling the air-fuel ratio, the catalyst oxygen storage amount (OSA) feedback control S10, S20, S30, S40, and S50 for controlling the air-fuel ratio using the oxygen storage amount (OSA) of the catalyst 120 and the target voltage value feedback control S100, S110, S120, S130, S140, and S150 for controlling the air-fuel ratio using the output voltage value of the binary oxygen sensor 160 in the rear of the catalyst are simultaneously performed.

Hereinafter, the catalyst oxygen storage amount (OSA) feedback control S10, S20, S30, S40, and S50 for controlling the air-fuel ratio using the oxygen storage amount (OSA) of the catalyst 120 will be first described.

During the catalyst oxygen storage amount (OSA) feedback control, it is first determined whether the feedback control enablement requirement is satisfied (S10). In one form, in the case where the oxygen sensor signal operates normally and the catalyst satisfies the activation temperature, it may be determined that the feedback control enablement requirement is satisfied.

If the feedback control enablement requirement is satisfied (S10: YES), the oxygen amount currently stored in the catalyst 120 is calculated using the oxygen storage amount (OSA) calculation model of the catalyst oxygen storage amount feedback controller 30 (S20). As described above, the oxygen amount stored in the catalyst 120 may be calculated by calculating the oxygen mass flow rate flowing into the catalyst from the air-fuel ratio measured by the oxygen sensor in front of the catalyst and the exhaust gas flow rate and integrating the calculated oxygen mass flow rate.

Next, the catalyst oxygen storage amount feedback controller 30 compares the calculated oxygen storage amount (OSA) with the predetermined threshold value (S30). As illustrated in FIG. 6, in the fuel-cutoff (FCO) section, fresh air flows into the catalyst 120, and the oxygen storage amount in the catalyst 120 temporarily reaches a saturated state. In this case, it is determined that the calculated oxygen storage amount (OSA) exceeds the predetermined threshold value (S30: YES), and the reach feedback control of the air-fuel ratio is performed so that the calculated oxygen storage amount (OSA) becomes equal to or smaller than the threshold value (S40). In this case, as illustrated in FIG. 6, the oxygen storage amount, which is calculated by the oxygen storage amount calculation model (OSA model), is gradually reduced to become equal to or smaller than the threshold value.

The catalyst oxygen storage amount feedback controller 30 performs the rich control of the air-fuel ratio, and if the oxygen storage amount (OSA) stored in the three-way catalyst 120 becomes smaller than the threshold value, it temporarily stops the rich feedback control of the air-fuel ratio using the oxygen storage amount (OSA) (S50). Further, the catalyst oxygen storage amount feedback controller 30 monitors whether the oxygen storage amount (OSA) is continuously maintained to be equal to or smaller than the threshold value by monitoring in real time the oxygen storage amount (OSA) being calculated in real time. If the oxygen storage amount (OSA) exceeds the threshold value again in accordance with the temporary lean combustion on the driving condition on which the load is large as in the dynamic driving mode and the variation width of the air-fuel ratio is large, the catalyst oxygen storage amount feedback controller 30 performs the air-fuel ratio rich feedback control again to control the fuel injection controller 10 so that the oxygen amount stored in the three-way catalyst 120 is always maintained to be equal to or smaller than the threshold value.

Next, the target voltage value feedback control S100, S110, S120, S130, S140, and S150 for controlling the air-fuel ratio using the output voltage value of the binary oxygen sensor 160 in the rear of the catalyst will be first described.

During the target voltage value feedback control, it is first determined whether the feedback control enablement requirement is satisfied (S100). In one form, in the case where the oxygen sensor signal operates normally, the catalyst satisfies the activation temperature, and the current vehicle driving region satisfies a normal driving region, it may be determined that the feedback control enablement requirement is satisfied.

If the feedback control enablement requirement is satisfied (S100: YES), the target voltage value that becomes the basis of the feedback control is calculated (S110). In one form, as described above, the target voltage value is configured as the output voltage value of the binary oxygen sensor 160 in a state where the air-fuel ratio satisfies the theoretical air-fuel ratio based on the load and the engine RPM in the driving region that satisfies the condition of the steady state. The target voltage value may be determined by the calculation model provided in the target voltage feedback controller 40, or the target voltage feedback controller 40 may receive information on the target voltage value from an external calculation module.

If the target voltage value is configured, it is determined whether the output voltage value of the binary oxygen sensor 160 in the rear of the catalyst exceeds or is smaller than the target voltage value (S120 and S140). Here, in order to simplify the control, it is determined whether the output voltage value is within an effective range of the target voltage value. The effective range of the target voltage value means a specific section in which the optimum efficiency of the catalyst that is expected through configuration of the target voltage value can be maintained to be equal to or larger than a predetermined level.

If it is determined that the output voltage value of the binary oxygen sensor 160 exceeds the effective range of the target voltage value over a specific range, the lean control of the air-fuel ratio is performed so that the output voltage value follows the target voltage value so as to achieve the optimum purification efficiency of the catalyst (S130).

Further, as illustrated in FIG. 6, if it is determined that the output voltage value of the binary oxygen sensor 160 is smaller than the effective range of the target voltage value, the rich control of the air-fuel ratio is performed so that the output voltage value follows the target voltage value so as to achieve the optimum purification efficiency of the catalyst (S150).

As illustrated in FIG. 6, if the oxygen storage amount (OSA) is put within the threshold value as the result of the feedback control based on the oxygen storage amount (OSA), the feedback control based on the oxygen storage amount (OSA) is temporarily interrupted (S50), monitoring of the oxygen storage amount (OSA) is continued, and in this period, the feedback control S130 and S150 is performed so that the output voltage value follows the target voltage value.

Although not illustrated in FIG. 3, as described above, the controller 180 may further control the air-fuel ratio so that the air-fuel ratio that is measured by the linear oxygen sensor 130 in front of the catalyst 120 satisfies the target air-fuel ratio. In this case, if the oxygen storage amount of the catalyst 120 is within the threshold value and the binary oxygen sensor 160 in the rear of the catalyst 120 is within the range of the target voltage value, it is possible to perform the optimum air-fuel ratio control suitable to the driving region based on the measurement value of the linear oxygen sensor 130 in front of the catalyst.

FIG. 7 is a graph illustrating exhaust gas purification effects in the case of performing only a trim control (target voltage feedback control) and in the case of performing a control according to one form of the present disclosure.

As illustrated in FIG. 7, in the case of performing the trim control only, the oxygen storage amount (OSA) calculated by the oxygen storage amount calculation model (OSA model) frequently exceeds the oxygen storage amount (OSA) limit range (threshold value). Further, it can be known that the accumulated amount of NOx is greatly increased in accordance with the time variation in comparison with the present disclosure. Further, as for the NOx detection amount in the rear of the catalyst, it can be known that relatively a large amount of NOx is discharged without being purified in comparison with the present disclosure.

According to the present disclosure, it can be known that the optimum purification efficiency of the catalyst can be maintained promptly and stably.

While the present disclosure has been described with respect to the specific forms, it will be apparent to those skilled in the art that various changes and modifications may be made without departing from the spirit and scope of the present disclosure.

What is claimed is:

1. A method for controlling an air-fuel ratio based on an oxygen storage amount of a catalyst, the method comprising:

calculating, by a controller, the oxygen storage amount of the catalyst based on an air-fuel ratio measured by a front oxygen sensor arranged in front of the catalyst and a flow rate of an exhaust gas;

performing, by the controller, a catalyst oxygen storage amount feedback control for a rich control of the air-fuel ratio so that the oxygen storage amount of the catalyst is within a threshold value; and performing, by the controller, a target voltage feedback control for a lean or rich control of the air-fuel ratio so that an output voltage value of a rear oxygen sensor arranged in rear of the catalyst satisfies a target voltage value, comparing the calculated oxygen storage amount with the threshold value;

when the calculated oxygen storage amount exceeds the threshold value, performing the catalyst oxygen storage amount feedback control for the rich control of the air-fuel ratio so that the oxygen storage amount becomes equal to or less than the threshold value; and when the calculated oxygen storage amount is equal to or less than the threshold value, performing the target voltage feedback control.

2. The method according to claim 1, wherein performing the target voltage feedback control includes:

calculating the target voltage value based on a current driving condition of a vehicle and a theoretical air-fuel ratio;

comparing the output voltage value of the rear oxygen sensor with the calculated target voltage value;

when the output voltage value of the rear oxygen sensor is greater than the target voltage value, performing the lean control of the air-fuel ratio so that the output voltage value follows the target voltage value; and when the output voltage value of the rear oxygen sensor is less than the target voltage value, performing the rich control of the air-fuel ratio so that the output voltage value follows the target voltage value.

3. The method according to claim 2, further comprising:

when the calculated oxygen storage amount is equal to or less than the threshold value, interrupting the catalyst oxygen storage amount feedback control and monitoring the oxygen storage amount being calculated in real time; and when the oxygen storage amount being calculated in real time exceeds the threshold value, interrupting the target voltage feedback control and resuming the catalyst oxygen storage amount feedback control.

4. The method according to claim 1, wherein calculating the oxygen storage amount of the catalyst comprises:

calculating an oxygen mass flow rate flowing into the catalyst from the air-fuel ratio measured by the front oxygen sensor and a flow rate of an exhaust gas; and calculating an oxygen storage capacity of the catalyst by integrating the oxygen mass flow rate.

5. The method according to claim 1, further comprising:

determining, by the controller, whether a condition to perform the catalyst oxygen storage amount feedback control is satisfied; and performing, by the controller, the catalyst oxygen storage amount feedback control when the condition is satisfied.

6. The method according to claim 1, further comprising:

performing, by the controller, the lean control or the rich control of the air-fuel ratio so that the air-fuel ratio measured by a front oxygen sensor arranged in front of the catalyst follows a theoretical air-fuel ratio.

7. The method according to claim 1, wherein the target voltage feedback control comprises:

calculating the target voltage value based on a current driving condition of a vehicle and a theoretical air-fuel ratio;

comparing the output voltage value of the rear oxygen sensor with the calculated target voltage value;

when the output voltage value of the rear oxygen sensor is greater than the target voltage value, performing the lean control of the air-fuel ratio so that the output voltage value follows the target voltage value; and when the output voltage value of the rear oxygen sensor is less than the target voltage value, performing the rich control of the air-fuel ratio so that the output voltage value follows the target voltage value.

8. The method according to claim 7, further comprising:

determining, by the controller, whether a condition to perform the target voltage feedback control is satisfied; and performing, by the controller, the target voltage feedback control when the condition is satisfied.

9. A system for controlling an air-fuel ratio based on an oxygen storage amount of a catalyst, the system comprising:

an engine that is a power source;

the catalyst installed on an exhaust line of the engine and configured to purify an exhaust gas being discharged from the engine;

first and second oxygen sensors respectively installed on an upstream and a downstream of the catalyst on the exhaust line; and a controller configured to perform a catalyst oxygen storage amount feedback control and a target voltage feedback control so as to control the air-fuel ratio, wherein the catalyst oxygen storage amount feedback control is configured to perform a rich control of the air-fuel ratio so that the oxygen storage amount of the catalyst is within a threshold value, wherein the target voltage feedback control is configured to perform a lean or rich control of the air-fuel ratio so that an output voltage value of the second oxygen sensor satisfies a target voltage value, and wherein:

when the oxygen storage amount of the catalyst exceeds the threshold value, the controller is configured to perform the catalyst oxygen storage amount feedback control, and when the oxygen storage amount of the catalyst is equal to or less than the threshold value, the controller is configured to perform the target voltage feedback control.

* * * * *